US008634577B2

(12) United States Patent
Breebaart

(10) Patent No.: US 8,634,577 B2
(45) Date of Patent: Jan. 21, 2014

(54) AUDIO DECODER

(75) Inventor: Dirk Jeroen Breebaart, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 978 days.

(21) Appl. No.: 12/521,884

(22) PCT Filed: Jan. 7, 2008

(86) PCT No.: PCT/IB2008/050029
§ 371 (c)(1),
(2), (4) Date: Jul. 1, 2009

(87) PCT Pub. No.: WO2008/084427
PCT Pub. Date: Jul. 17, 2008

(65) Prior Publication Data

US 2010/0076774 A1 Mar. 25, 2010

(30) Foreign Application Priority Data

Jan. 10, 2007 (EP) ..... 07100339

(51) Int. Cl.
*H04R 5/00* (2006.01)

(52) U.S. Cl.
USPC ..... 381/94.2; 381/18; 381/22; 381/23; 381/17; 704/201; 704/200.1; 704/500; 700/94

(58) Field of Classification Search
USPC ..... 381/94.2, 88.01–88.04, 2, 22, 23, 17, 381/119, 18, 19, 81; 704/201, 230, 704/500–504, 200.1, 219; 700/94
See application file for complete search history.

(56) References Cited

U.S. PATENT DOCUMENTS 5,974,380 A * 10/1999 Smyth et al. ..... 704/229
5,978,762 A * 11/1999 Smyth et al. ..... 704/229

(Continued)

FOREIGN PATENT DOCUMENTS

EP 0925689 B1 7/2002
EP 1565036 A2 8/2005

(Continued)

OTHER PUBLICATIONS

Breebaart et al: "MPEG Spatial Audio Coding/MPEG Surround:Overview and Current Status"; Audio Engineering Society Convention Paper, Presented at the 119th Convention, New York, NY, Oct. 7-10, 2005, pp. 1-17.

(Continued)

*Primary Examiner* — Vijay B Chawan

(57) ABSTRACT

An audio decoder (100) comprising: effect means, decoding means, and rendering means. The effect means (500) generate modified down-mix audio signals from received down-mix audio signals. Said received down-mix audio signals comprise a down-mix of a plurality of audio objects. Said modified down-mix audio signals are obtained by applying effects to estimated audio signals corresponding to audio objects comprised in said received down-mix audio signals. Said estimated audio signals are derived from the received down-mix audio signals based on received parametric data. Said received parametric data comprise a plurality of object parameters for each of the plurality of audio objects. Said modified down-mix audio signals based on a type of the applied effect are decoded by decoding means or rendered by rendering means or combined with the output of rendering means. The decoding means (300) are arranged for decoding the audio objects from the down-mix audio signals or the modified down-mix audio signals based on the parametric data. The rendering means (400) are arranged for generating at least one output audio signal from the decoded audio objects.

17 Claims, 4 Drawing Sheets

(56) References Cited

U.S. PATENT DOCUMENTS

| | | | | |
|---|---|---|---|---|
| 6,487,535 | B1 * | 11/2002 | Smyth et al. | 704/500 |
| 6,882,686 | B2 | 4/2005 | Jayant et al. | |
| 7,715,569 | B2 * | 5/2010 | Oh et al. | 381/22 |
| 7,783,048 | B2 * | 8/2010 | Oh et al. | 381/22 |
| 7,783,050 | B2 * | 8/2010 | Oh et al. | 381/22 |
| 7,822,617 | B2 * | 10/2010 | Taleb et al. | 704/501 |
| 7,945,055 | B2 * | 5/2011 | Taleb et al. | 381/22 |
| 7,966,191 | B2 * | 6/2011 | Schuijers et al. | 704/500 |
| 8,223,881 | B2 * | 7/2012 | Meyer et al. | 375/295 |
| 2003/0035553 | A1 * | 2/2003 | Baumgarte et al. | 381/94.2 |
| 2006/0195314 | A1 * | 8/2006 | Taleb et al. | 704/200.1 |
| 2006/0246868 | A1 * | 11/2006 | Taleb et al. | 455/303 |
| 2008/0255856 | A1 * | 10/2008 | Schuijers et al. | 704/500 |
| 2008/0262850 | A1 * | 10/2008 | Taleb et al. | 704/500 |
| 2009/0157411 | A1 * | 6/2009 | Kim et al. | 704/500 |
| 2011/1196685 | | 8/2011 | Kim et al. | |

FOREIGN PATENT DOCUMENTS

| | | | |
|---|---|---|---|
| EP | 1613089 | A1 | 1/2006 |
| JP | 2009526467 | A | 7/2009 |
| JP | 2010505142 | A | 2/2010 |
| WO | 2007091870 | A1 | 8/2007 |

OTHER PUBLICATIONS

Faller et al: "Binaural Cue Coding—Part II:Schemes and Applications"; IEEE Transactions on Speech and Audio Processing, vol. 11, No. 6, Nov. 2003, pp. 521-531.

* cited by examiner

AUDIO DECODER

TECHNICAL FIELD

The invention relates to an audio decoder in particular, but not exclusively, to an MPEG Surround decoder or object-oriented decoder.

TECHNICAL BACKGROUND

In (parametric) spatial audio (en)coders, parameters are extracted from the original audio signals so as to produce a reduced number of down-mix audio signals (for example only a single down-mix signal corresponding to a mono, or two down-mix signals for a stereo down mix), and a corresponding set of parameters describing the spatial properties of the original audio signal. In (parametric) spatial audio decoders, the spatial properties described by the transmitted spatial parameters are used to recreate a spatial multi-channel signal, which closely resembles the original multi-channel audio signal.

Recently, techniques for processing and manipulating of individual audio objects at the decoding side have attracted significant interest. For example, within the MPEG framework, a workgroup has been started on object-based spatial audio coding. The aim of this workgroup is to "explore new technology and reuse of current MPEG Surround components and technologies for the bit rate efficient coding of multiple sound sources or objects into a number of down-mix channels and corresponding spatial parameters". In other words, the aim is to encode multiple audio objects in a limited set of down-mix channels with corresponding parameters. At the decoder side, users interact with the content for example by repositioning the individual objects.

Such interaction with the content is easily realized in object-oriented decoders. It is then realized by including a rendering that follows the decoding. Said rendering is combined with the decoding to prevent the need of determining individual objects. The currently available dedicated rendering comprises positioning of objects, volume adjusting, or equalization of the rendered audio signals.

One disadvantage of the known object-oriented decoders with the incorporated rendering is that they permit a limited set of manipulations of objects, because they do not produce or operate on the individual objects. On the other hand explicit decoding of the individual audio objects is very costly and inefficient.

SUMMARY OF THE INVENTION

It is an object of the invention to provide an enhanced decoder for decoding audio objects that allows a wider range of manipulations of objects without a need for decoding the individual audio objects for this purpose.

This object is achieved by an audio decoder according to the invention. It is assumed that a set of objects, each with its corresponding waveform, has previously been encoded in an object-oriented encoder, which generates a down-mix audio signal (a single signal in case of a single channel), said down-mix audio signal being a down-mix of a plurality of audio objects and corresponding parametric data. The parametric data comprises a set of object parameters for each of the different audio objects. The receiver receives said down-mix audio signal and said parametric data. This down-mix audio signal is further fed into effect means that generate modified down-mix audio signal by applying effects to estimates of audio signals corresponding to selected audio objects comprised in the down-mix audio signal. Said estimates of audio signals are derived based on the parametric data. The modified down-mix audio signal is further fed into decoding means, or rendering means, or combined with the output of rendering means depending on a type of the applied effect, e.g. an insert or send effect. The decoding means decode the audio objects from the down-mix audio signal fed into the decoding means, said down-mix audio signal being the originally received down-mix audio signal or the modified down-mix audio signal. Said decoding is performed based on the parametric data. The rendering means generate a spatial output audio signal from the audio objects obtained from the decoding means and optionally from the effect means, depending on the type of the applied effect.

The advantage of the decoder according to the invention is that in order to apply various types of effects it is not needed that the object, to which the effect is to be applied, is available. Instead, the invention proposes to apply the effect to the estimated audio signals corresponding to the objects before or in parallel to the actual decoding. Therefore, explicit object decoding is not required, and the rendering emerged in the decoder is preserved.

In an embodiment, the decoder further comprises modifying means for modifying the parametric data when a spectral or temporal envelope of an estimated audio signal corresponding to the object or plurality of objects is modified by the insert effect.

An example of such an effect is a non-linear distortion that generates additional high frequency spectral components, or a multi-band compressor. If the spectral characteristic of the modified audio signal has changed, applying the unmodified parameters comprised in the parametric data, as received, might lead to undesired and possibly annoying artifacts. Therefore, adapting the parameters to match the new spectral or temporal characteristics improves the quality of the resulting rendered audio signal.

In an embodiment, the generation of the estimated audio signals corresponding to an audio object or plurality of objects comprises time/frequency dependent scaling of the down-mix audio signals based on the power parameters corresponding to audio objects, said power parameters being comprised in the received parametric data.

The advantage of this estimation is that it comprises a multiplication of the down-mix audio signal. This makes the estimation process simple and efficient.

In an embodiment, the decoding means comprise a decoder in accordance with the MPEG Surround standard and conversion means for converting the parametric data into parametric data in accordance with the MPEG Surround standard.

The advantage of using the MPEG Surround decoder is that this type of decoder is used as a rendering engine for an object-oriented decoder. In this case, the object-oriented parameters are combined with user-control data and converted to MPEG Surround parameters, such as level differences and correlation parameters between channels (pairs). Hence the MPEG Surround parameters result from the combined effect of object-oriented parameters, i.e. transmitted information, and the desired rendering properties, i.e. user-controllable information set at the decoder side. In such a case no intermediate object signals are required.

The invention further provides a receiver and a communication system, as well as corresponding methods.

In an embodiment, the insert and send effects are applied simultaneously. Using of, for example, insert effects does not exclude use of send effects, and vice versa.

The invention further provides a computer program product enabling a programmable device to perform the method according to the invention.

BRIEF DESCRIPTION OF THE DRAWINGS

These and other aspects of the invention will be apparent from and elucidated with reference to the embodiments shown in the drawings, in which.

Throughout the figures, same reference numerals indicate similar or corresponding features. Some of the features indicated in the drawings are typically implemented in software, and as such represent software entities, such as software modules or objects.

DETAILED DESCRIPTION OF THE PREFERRED EMBODIMENTS

Figure 1A:
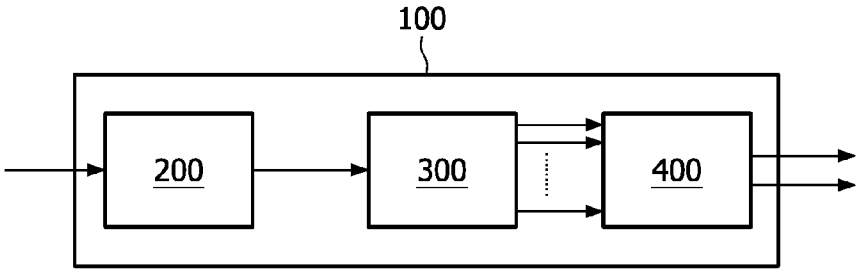
FIG. 1A schematically shows an object-oriented decoder.

FIG. 1A schematically shows an object-oriented decoder 100 as known for example from C. Faller: "Parametric Joint-Coding of Audio Sources", AES 120$^{th}$ Convention, Paris, France, Preprint 6752, May 2006. It is assumed that a set of objects, each with its corresponding waveform, has previously been encoded in an object-oriented encoder, which generates a down-mix audio signal (a single signal in case of a single channel, or two signals in case of two channels (=stereo)), said down-mix audio signal being a down-mix of a plurality of audio objects characterized by corresponding parametric data. The parametric data comprises a set of object parameters for each of the different audio objects. The receiver 200 receives said down-mix audio signal and said parametric data.

The signal fed into the receiver 200 is a single signal that corresponds to the stream of multiplexed down-mix audio data that corresponds to the down-mix audio signal and the parametric data. The function of the receiver is then demultiplexing of the two data streams. If the down-mix audio signal is provided in compressed form (such as MPEG-1 layer 3), receiver 200 also performs decompression or decoding of the compressed audio signal into a time-domain audio down-mix signal.

Although, the input of the receiver 200 is depicted a single signal/data path it could also comprise multiple data paths for separate down-mix signals and/or parametric data. Consequently the down-mix signals and the parametric data are fed into decoding means 300 that decode the audio objects from the down-mix audio signals based on the parametric data. The decoded audio objects are further fed into rendering means 400 for generating at least one output audio signal from the decoded audio objects. Although, the decoding means and rendering means are drawn as separate units, they very often are merged together. As a result of such merger of the decoding and rendering processing means there is no need for explicit decoding of individual audio objects. Instead rendered audio signals are provided at the much lower computational cost, and with no loss of audio quality.

Figure 1B:
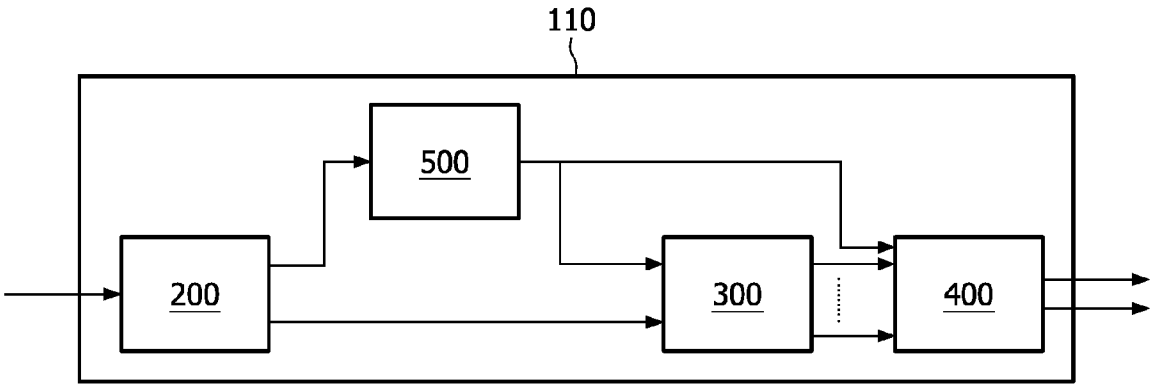
FIG. 1B schematically shows an object-oriented decoder according to the invention.

FIG. 1B schematically shows an object-oriented decoder 110 according to the invention. The receiver 200 receives said down-mix audio signal and said parametric data. This down-mix audio signal and the parametric data are further fed into effect means 500 that generate modified down-mix audio signal by applying effects to estimates of audio signals corresponding to selected audio objects comprised in the down-mix audio signal. Said estimates of audio signals are derived based on the parametric data. The modified down-mix audio signal is further fed into decoding means 300, or rendering means 400, or combined with the output of rendering means depending on a type of the applied effect, e.g. an insert or send effect. The decoding means 300 decode the audio objects from the down-mix audio signal fed into the decoding means, said down-mix audio signal being the originally received down-mix audio signal or the modified down-mix audio signal. Said decoding is performed based on the parametric data. The rendering means 400 generate a spatial output audio signal from the audio objects obtained from the decoding means 300 and optionally from the effect means 400, depending on the type of the applied effect.

Figure 2:
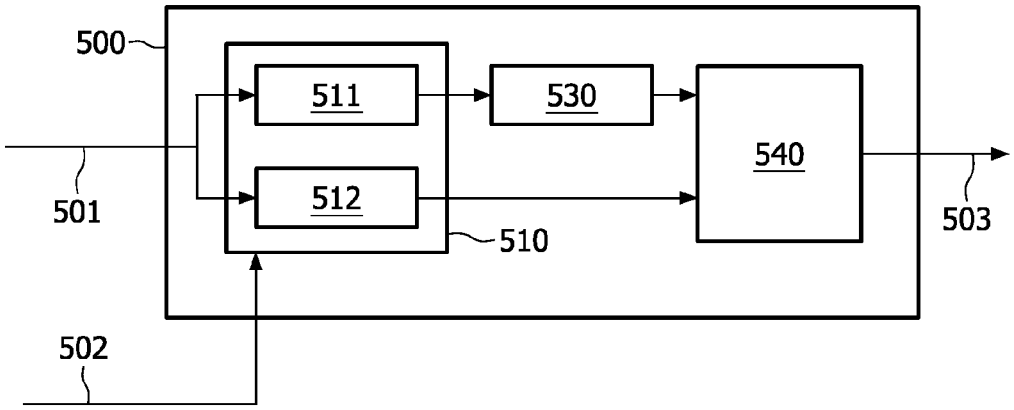
FIG. 2 shows an example of effect means for an insert effect.

FIG. 2 shows an example of effect means 500 for an insert effect. The down-mix signals 501 are fed into the effect means 500; these signals are fed in parallel to units 511 and 512 that are comprised in estimation means 510. The estimation means 510 generate the estimated audio signals corresponding to an object or plurality of objects to which the insert effect is to be applied, and the estimated audio signal corresponding to the remaining objects. The estimation of audio signals corresponding to an object or plurality of objects to which the insert effect is to be applied is performed by the unit 511, while the estimation of the audio signal corresponding to the remaining objects is performed by the unit 512. Said estimation is based on the parametric data 502 that is obtained from the receiver 200. Consequently the insert effect is applied by insert means 530 on the estimated audio signals corresponding to an object or plurality of objects to which the insert effect is to be applied. An adder 540 adds up the audio signals provided from the insert means 530 and the estimated audio signal corresponding to the remaining objects, therefore assembling again all the objects together. The resulting modified down-mix signal 503 is further fed into the decoding means 300 of the object-oriented decoder 110. In the remainder of the text whenever units 200, 300, or 400 are referred to they are comprised in an object-oriented decoder 110.

The examples of insert effects are among others: dynamic range compression, generation of distortion (e.g. to simulate guitar amplifiers), or vocoder. This type of effects is applied preferably on a limited (preferably single) set of audio objects.

Figure 3:
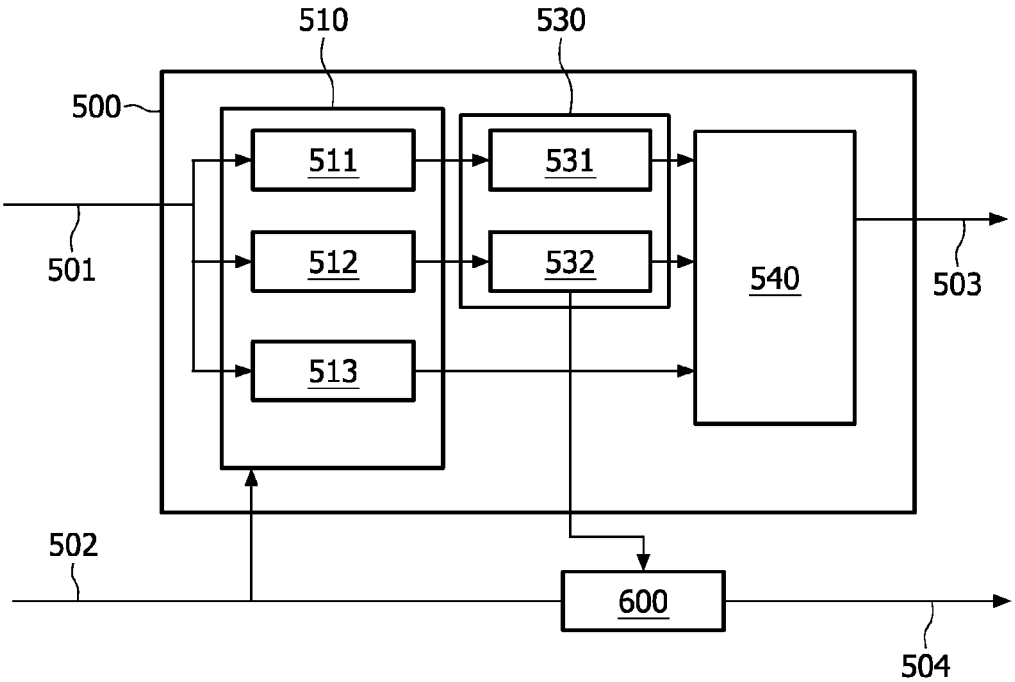
FIG. 3 shows modifying means for modifying the parametric data when a spectral envelope of an estimated audio signal corresponding to the object or plurality of objects is modified by the insert effect.

FIG. 3 shows modifying means 600 for modifying the parametric data when a spectral envelope of an estimated audio signal corresponding to the object or plurality of objects is modified by the insert effect. The units 511 and 512 are estimating, for example, individual audio objects, while the unit 513 estimates the remaining audio objects together. The insert means 530 comprise separate units 531 and 532 that apply insert effects on the estimated signals obtained from the units 511 and 512, respectively. An adder 540 adds up the audio signals provided from the insert means 530 and the estimated audio signal corresponding to the remaining objects, therefore assembling again all the objects together. The resulting modified down-mix signal 503 is further fed into the decoding means 300 of the object-oriented decoder 110.

The insert effects used in the units 531 and 532 are either of the same type or they differ. The insert effect used by the unit 532 is for example a non-linear distortion that generates additional high frequency spectral components, or a multi-band compressor. If the spectral characteristic of the modified audio signal has changed, applying the unmodified parameters comprised in the parametric data as received in the decoding means 300, might lead to undesired and possibly annoying artifacts. Therefore, adapting the parametric data to match the new spectral characteristics improves the quality of the resulting audio signal. This adaptation of the parametric data is performed in the unit 600. The adapted parametric data 504 is fed into the decoding means 300 and is used for decoding of the modified down-mix signal(s) 503.

It should be noted that the two units 531 and 532 comprised in the insert means 530 are just an example. The number of the units can vary depending on the number of insert effects to be applied. Further, the units 531 and 532 can be implemented in hardware or software.

Figure 4:
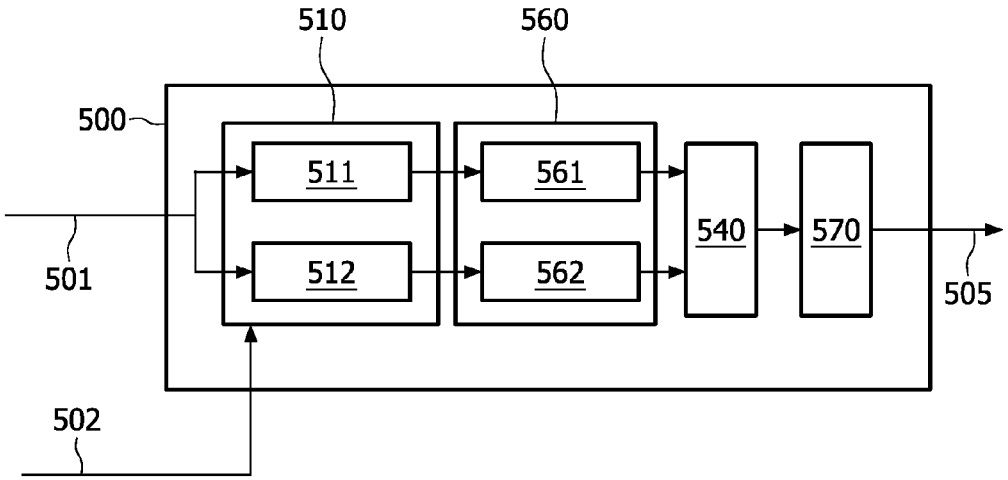
FIG. 4 shows an example of effect means for a send effect.

FIG. 4 shows an example of effect means for a send effect. The down-mix signals 501 are fed into the effect means 500, these signals are fed in parallel to units 511 and 512 that are comprised in estimation means 510. The estimation means 510 generate the estimated audio signals corresponding to an object or plurality of objects to which the send effect is to be applied. Said estimation is based on the parametric data 502 that is obtained from the receiver 200. Consequently gains are applied by gain means 560 on the estimated audio signals corresponding to an object or plurality of objects obtained from the estimation means 510. Gains, which also could be referred as weights, determine an amount of the effect per object or plurality of objects. Each of units 561 and 562 applies gain to individual audio signals obtained from the estimating means. Each of these units might apply various gains.

An adder 540 adds up the audio signals provided from the gain means 560, and a unit 570 applies the send effect. The resulting signal 505, also called the "wet" output, is fed into the rendering means, or alternatively, is mixed with (or added to) the output of the rendering means.

The examples of the send effects are among others reverberation, modulation effects such e.g. chorus, flanger, or phaser.

It should be noted that the two units 561 and 562 comprised in the gain means 560 are just an example. The number of the units can very depending on the number of signals corresponding to audio objects or plurality of audio objects for which the level of the send effect is to be set.

The estimation means 510 and the gain means 560 can be combined in a single processing step that estimates a weighted combination of multiple object signals. The gains 561 and 562 can be incorporated in the estimation means 511 and 512, respectively. This is also described in the equations below, where Q is a (estimation of a) weighted combination of object signals and is obtained by one single scaling operation per time/frequency tile.

The gains per object or combination of objects can be interpreted as 'effect send levels'. In several applications, the amount of effect is preferably user-controllable per object. For example, the user might desire one of the objects without reverberation, another object with a small amount of reverberation, and yet another object with full reverberation. In such an example, the gains per object could be equal to 0, 0.5 and 1.0, for each of the respective objects.

In an embodiment, the generation of the estimated audio signals corresponding to an audio object or plurality of objects comprises time/frequency dependent scaling of the down-mix audio signals based on the power parameters corresponding to audio objects, said power parameters being comprised in the parametric data.

This embodiment is explained for the following example. At the encoder I object signals $s_i[n]$, i=0, . . . , I−1, with n the sample index are down-mixed to create a down-mix signal x[n], by summation of the down-mix signals:

$$x[n] = \sum_i s_i[n]$$

The down-mix signal is accompanied by object-oriented parameters that describe the (relative) signal power of each object within individual time/frequency tiles of the down-mix signal x[n]. The object signals $s_i[n]$ are e.g. first windowed using overlapping analysis windows w[n]:

$$s_i[n,m]=s_i[n+\mathrm{mL}/2]w[n],$$

With L the length of the window and e.g. L/2 the corresponding hop size (assuming 50% overlap), and m the window index. A typical form of the analysis window is a Hanning window:

$$w[n] = \sin\left(\frac{\pi n}{L}\right).$$

The resulting segmented signals $s_i[n,m]$ are subsequently transformed to the frequency domain using an FFT:

$$S_i[k, m] = \sum_n s_i[n, m]e^{-2\pi jkn/L},$$

With k the FFT bin index. The FFT bin indices k are subsequently grouped into parameter bands b. In other words, each parameter band b corresponds to a set of adjacent frequency bin indices k. For each parameter band b, and each segment m of each object signal $S_i[k,m]$, a power value $\sigma_i^2[b,m]$ is computed:

$$\sigma_i^2[b, m] = \frac{\sum_{k=k(b)}^{k=k(b+1)-1} S_i[k, m]S_i^*[k, m]}{k(b+1) - k(b)},$$

with (*) being the complex conjugation operator. These parameters $\sigma_i^2[b,m]$ are comprised in the parametric data (preferably quantized in the logarithmic domain).

The estimation process of an object or plurality of objects at the object-oriented audio decoder comprises time/frequency dependent scaling of the down mix audio signal. A discrete-time down-mix signal x[n] with n the same index is split into time/frequency tiles X[k,m] with k a frequency index and m a frame (temporal segment) index. This is achieved by e.g. windowing the signal x[n] with an analysis window x[n]:

$$x[n,m]=x[n+\mathrm{mL}/2]w[n],$$

With L the window length and L/2 the corresponding hop size. In this case, a preferred analysis window is given by the square root of the Hanning window:

$$w[n] = \sqrt{\sin\left(\frac{\pi n}{L}\right)}$$

Subsequently, the windowed signal w[n,m] is transformed to the frequency domain using an FFT:

$$X[k, m] = \sum_n x[n, m] e^{-2\pi jkn/L},$$

The frequency-domain components of X[k,m] are subsequently grouped into so-called parameter bands b (b=0, . . . , B−1). These parameter bands coincide with the parameter bands at the encoder. The decoder-side estimate $\hat{S}_i[k,m]$ of segment m of object i is given by:

$$\hat{S}_i[k, m] = X[k, m] \sqrt{\frac{\sigma_i^2[b(k), m]}{\sum_i \sigma_i^2[b(k), m]}},$$

With b(k) the parameter band that was associated with frequency index k.

A weighted combination Q of object signals $S_i$ with weights $g_i$ is given by:

$$Q[k, m] = \sum_i g_i S_i[k, m].$$

In the object-oriented decoder, Q can be estimated according to:

$$\hat{Q}[k, m] = \sum_i g_i \hat{S}_i[k, m] = X[k, m] \sqrt{\frac{g_i^2 \sigma_i^2[b(k), m]}{\sum_i \sigma_i^2[b(k), m]}}.$$

In other words, an object signal or any linear combination of plurality of audio object signals can be estimated at the proposed object-oriented audio decoder by a time-frequency dependent scaling of the down-mix signal X[k,m].

In order to result in time-domain output signals, each estimated object signal is transformed to the time domain (using an inverse FFT), multiplied by a synthesis window (identical to the analysis window), and combined with previous frames using overlap-add.

In an embodiment, the generation of the estimated audio signals comprises weighting an object or a combination of a plurality of objects by means of time/frequency dependent scaling of the down-mix audio signals based on the power parameters corresponding to audio objects, said power parameters being comprised in the received parametric data.

It should be noted that a send effect unit might have more output signals than input signals. For example in the case of a stereo or multi-channel reverberation unit has a mono input signal.

In an embodiment, the down-mixed signal and the parametric data are in accordance with an MPEG Surround standard. The existing MPEG Surround decoder next to decoding functionality also functions as a rendering device. In such a case, no intermediate audio signals corresponding to the decode objects are required. The object decoding and rendering are combined into a single device.

Figure 5:
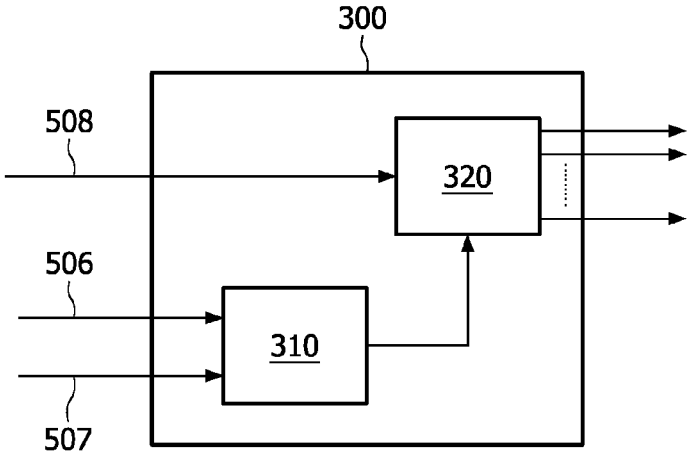
FIG. 5 shows decoding means the decoding means comprise a decoder in accordance with the MPEG Surround standard and conversion means for converting the parametric data into parametric data in accordance with the MPEG Surround standard.

FIG. 5 shows decoding means the decoding means 300 comprise a decoder 320 in accordance with the MPEG Surround standard and conversion means 310 for converting the parametric data into parametric data in accordance with the MPEG Surround standard. The signal(s) 508 corresponding to the down-mix signal(s) 501 or the modified down-mix signal(s) 503, when the insert effects are applied, is fed into the MPEG Surround decoder 320. The conversion means 310 based on the parametric data 506 and the user-control data 507 converts the parametric data into parametric data in accordance with the MPEG Surround standard. The parametric data 506 is the parametric data 502 or the modified parametric data 504, when the spectral envelope of an estimated audio signal corresponding to the object or plurality of objects is modified by the insert effect. The user-control data 507 may for example indicate the desired spatial position of one or plurality of audio objects.

According to one of embodiments, the method comprises the steps of receiving at least one down-mix audio signal and parametric data, generating modified down-mix audio signals, decoding the audio objects from the down-mix audio signals, and generating at least one output audio signal from the decoded audio objects. In the method each down-mix audio signal comprises a down-mix of a plurality of audio objects. The parametric data comprises a plurality of object parameters for each of the plurality of audio objects. The modified down-mix audio signals are obtained by applying effects to estimated audio signals corresponding to audio objects comprised in said down-mix audio signals. The estimated audio signals are derived from the down-mix audio signals based on the parametric data. The modified down-mix audio signals based on a type of the applied effect are decoded by decoding means 300 or rendered by rendering means 400. The decoding step is performed by the decoding means 300 for the down-mix audio signals or the modified down-mix audio signals based on the parametric data.

The last step of generating at least one output audio signal from the decoded audio objects, which can be called a rendering step, can be combined with the decoding step into one processing step.

In an embodiment a receiver for receiving audio signals comprises: a receiving element, effect means, decoding means, and rendering means. The receiver element receives from a transmitter at least one down-mix audio signal and parametric data. Each down-mix audio signal comprises a down-mix of a plurality of audio objects. The parametric data comprises a plurality of object parameters for each of the plurality of audio objects.

The effect means generate modified down-mix audio signals. These modified down-mix audio signals are obtained by applying effects to estimated audio signals corresponding to audio objects comprised in said down-mix audio signals. The estimated audio signals are derived from the down-mix audio signals based on the parametric data. The modified down-mix audio signals based on a type of the applied effect are decoded by decoding means or rendered by rendering means.

The decoding means decode the audio objects from the down-mix audio signals or the modified down-mix audio signals based on the parametric data. The rendering means generate at least one output audio signal from the decoded audio objects.

Figure 6:
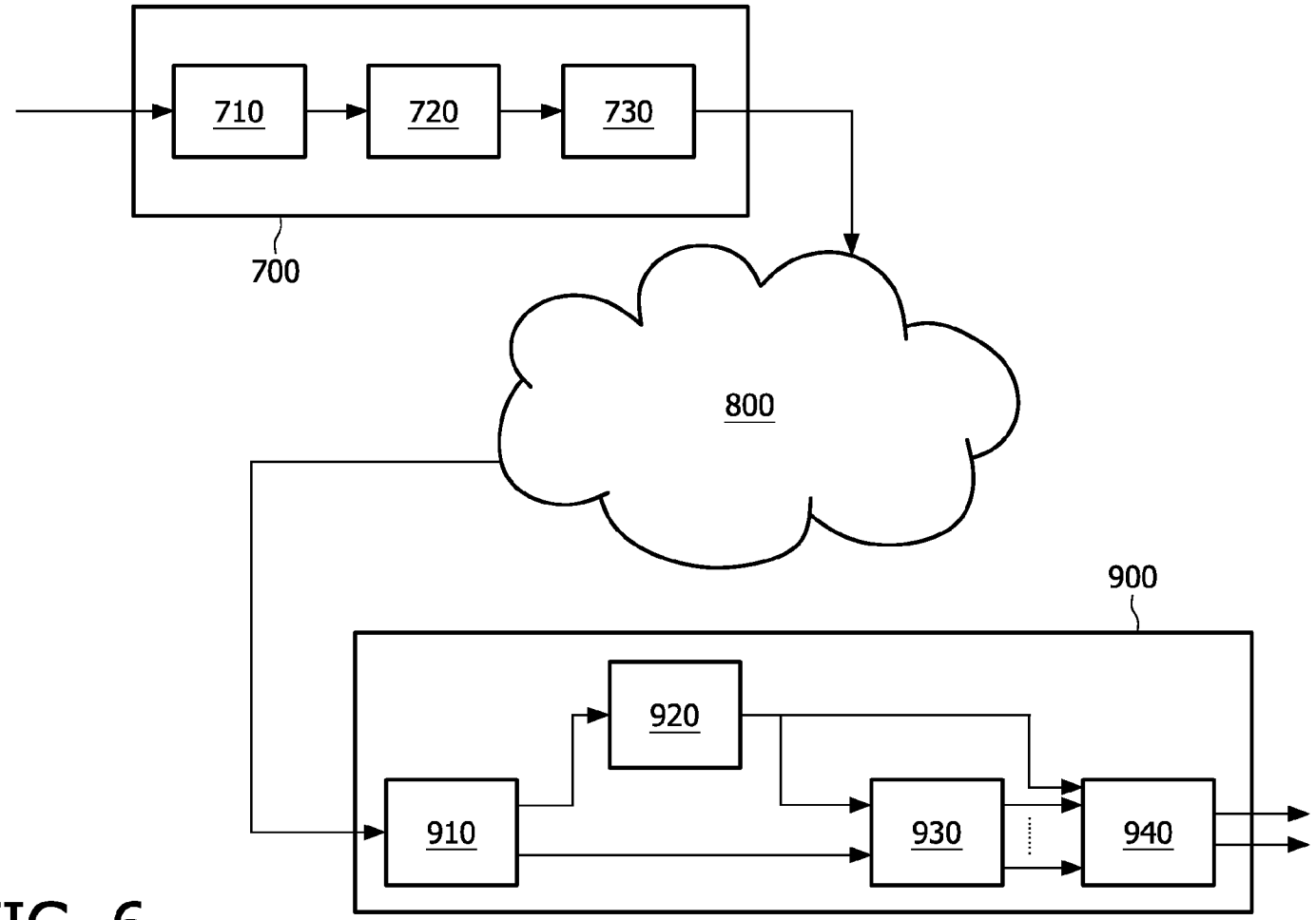
FIG. 6 shows a transmission system for communication of an audio signal in accordance with some embodiments of the invention.

FIG. 6 shows a transmission system for communication of an audio signal in accordance with some embodiments of the invention. The transmission system comprises a transmitter 700, which is coupled with a receiver 900 through a network 800. The network 800 could be e.g. Internet.

The transmitter 700 is for example a signal recording device and the receiver 900 is for example a signal player device. In the specific example when a signal recording function is supported, the transmitter 700 comprises means 710 for receiving a plurality of audio objects. Consequently, these objects are encoded by encoding means 720 for encoding the plurality of audio objects in at least one down-mix audio signal and parametric data. An embodiment of such encoding means 620 is given in Faller, C., "Parametric joint-coding of audio sources", Proc. 120$^{th}$ AES Convention, Paris, France, May 2006. Each down-mix audio signal comprises a down-mix of a plurality of audio objects. Said parametric data comprises a plurality of object parameters for each of the plurality of audio objects. The encoded audio objects are transmitted to the receiver 900 by means 730 for transmitting down-mix audio signals and the parametric data. Said means 730 have an interface with the network 800, and may transmit the down-mix signals through the network 800.

The receiver 900 comprises a receiver element 910 for receiving from the transmitter 700 at least one down-mix audio signal and parametric data. Each down-mix audio signal comprises a down-mix of a plurality of audio objects. Said parametric data comprises a plurality of object parameters for each of the plurality of audio objects. The effect means 920 generate modified down-mix audio signals. Said modified down-mix audio signals are obtained by applying effects to estimated audio signals corresponding to audio objects comprised in said down-mix audio signals. Said estimated audio signals are derived from the down-mix audio signals based on the parametric data. Said modified down-mix audio signals based on a type of the applied effect are decoded by decoding means, or rendered by rendering means, or combined with the output of rendering means. The decoding means decode the audio objects from the down-mix audio signals or the modified down-mix audio signals based on the parametric data. The rendering means generate at least one output audio signal from the decoded audio objects.

In an embodiment, the insert and send effects are applied simultaneously.

In an embodiment, the effects are applied in response to user input. The user can by means of e.g. button, slider, knob, or graphical user interface, set the effects according to own preferences.

It should be noted that the above-mentioned embodiments illustrate rather than limit the invention, and those skilled in the art will be able to design many alternative embodiments without departing from the scope of the appended claims.

In the accompanying claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements, and by means of a suitably programmed computer.

The invention claimed is:

1. An audio decoder comprising:

effect means for generating modified down-mix audio signals from received down-mix audio signals, said received down-mix audio signals comprising a down-mix of a plurality of audio objects, said modified down-mix audio signals obtained by applying effects to estimated audio signals corresponding to audio objects comprised in said received down-mix audio signals, said estimated audio signals being derived from the received down-mix audio signals based on received parametric data, said received parametric data comprising a plurality of object parameters for each of the plurality of audio objects, said modified down-mix audio signals based on a type of the applied effect being decoded by decoding means or rendered by rendering means or combined with the output of rendering means;

the decoding means being arranged for decoding the audio objects from the down-mix audio signals or the modified down-mix audio signals based on the parametric data;

the rendering means being arranged for generating at least one output audio signal from the decoded audio objects.

2. The decoder as claimed in claim 1, wherein the effect means are arranged for providing an insert effect and comprise:

estimation means for generating the estimated audio signals corresponding to an object or plurality of objects to which the insert effect is to be applied, and generating the estimated audio signal corresponding to the remaining objects;

insert means for applying the insert effect on the estimated audio signals corresponding to an object or plurality of objects to which the insert effect is to be applied;

an adder for adding up the audio signals provided from the insert means and the estimated audio signal corresponding to the remaining objects.

3. The decoder as claimed in claim 2, wherein the decoder further comprises modifying means for modifying the parametric data when a spectral or temporal envelope of an estimated audio signal corresponding to the object or plurality of objects is modified by the insert effect.

4. The decoder as claimed in claim 1, wherein the effect means are arranged for providing a send effect and comprise:

estimation means for generating the estimated audio signals corresponding to an object or plurality of objects to which the send effect is to be applied;

gain means for determining an amount of the send effect for the estimated audio signals corresponding to the object or plurality of objects to which the send effect is to be applied;

an adder for adding the audio signals obtained from the gain means;

send means for applying the send effect on the audio signals obtained from the adder.

5. The decoder as claimed in claim 1, wherein the generation of the estimated audio signals corresponding to an audio object or plurality of objects comprises time/frequency dependent scaling of the down-mix audio signals based on the power parameters corresponding to audio objects, said power parameters being comprised in the parametric data.

6. The decoder as claimed in claim 5, wherein the generation of the estimated audio signals comprises weighting an object or a combination of a plurality of objects by means of time/frequency dependent scaling of the down-mix audio signals based on the power parameters corresponding to audio objects, said power parameters being comprised in the received parametric data.

7. The decoder as claimed in claim 1, wherein the down-mixed signal and the parametric data are in accordance with an MPEG Surround standard.

8. The decoder as claimed in claim 7, wherein the decoding means comprise a decoder in accordance with the MPEG Surround standard and conversion means for converting the parametric data into parametric data in accordance with the MPEG Surround standard.

9. A method of decoding audio signals, the method comprising:

receiving at least one down-mix audio signal and parametric data, each down-mix audio signal comprising a down-mix of a plurality of audio objects, said parametric data comprising a plurality of object parameters for each of the plurality of audio objects;

generating modified down-mix audio signals; said modified down-mix audio signals obtained by applying effects to estimated audio signals corresponding to audio objects comprised in said down-mix audio signals, said estimated audio signals being derived from the down-mix audio signals based on the parametric data, said modified down-mix audio signals based on a type of the applied effect being decoded by decoding means or rendered by rendering means or combined with the output of rendering means;

decoding the audio objects from the down-mix audio signals or the modified down-mix audio signals based on the parametric data;

generating at least one output audio signal from the decoded audio objects.

10. The method as claimed in claim 9, wherein the insert and send effects are applied simultaneously.

11. The method claimed in claim 9, wherein the effects are applied in response to a user input.

12. A receiver for receiving audio signals, the receiver comprising:

an audio decoder comprising:

effect means for generating modified down-mix audio signals from received down-mix audio signals, said received down-mix audio signals comprising a down-mix of a plurality of audio objects, said modified down-mix audio signals obtained by effects to effects estimated audio signals corresponding to audio objects comprised in said received down-mix audio signals, said estimated audio signals being derived from the received down-mix audio signals based on received parametric data, said received parametric data comprising a plurality of object parameters for each of the plurality of audio objects, said modified down-mix audio signals based on a type of the applied effect being decoded by decoding means or rendered by rendering means or combined with the output of rendering means;

the decoding means being arranged for decoding the audio objects from the down-mix audio signals or the modified down-mix audio signals based on the parametric data;

the rendering means being arranged for generating at least one output audio signal from the decoded audio objects; and a receiver element for receiving from a transmitter at least one down-mix audio signal and parametric data, each down-mix audio signal comprising a down-mix of a plurality of audio objects, said parametric data comprising a plurality of object parameters for each of the plurality of audio objects, the receiver element being coupled to the effect means and the decoding means.

13. A communication system for communicating audio signals, the communication system comprising:

a transmitter comprising:

means for receiving a plurality of audio objects, encoding means for encoding the plurality of audio objects in at least one down-mix audio signal and parametric data, each down-mix audio signal comprising a down-mix of a plurality of audio objects, said parametric data comprising a plurality of object parameters for each of the plurality of audio objects, and means for transmitting down-mix audio signals and the parametric data to a receiver; and a receiver comprising:

a receiver element for receiving from said transmitter at least one down-mix audio signal and parametric data, each down-mix audio signal comprising a down-mix of a plurality of audio objects, said parametric data comprising a plurality of object parameters for each of the plurality of audio objects, and a decoder element comprising; a decoding means and an effect means, the receiver element being coupled to the effect means and the decoding means.

14. A method of receiving audio signals, the method comprising:

receiving from a transmitter at least one down-mix audio signal and parametric data, each down-mix audio signal comprising a down-mix of a plurality of audio objects, said parametric data comprising a plurality of object parameters for each of the plurality of audio objects;

generating modified down-mix audio signals; said modified down-mix audio signals obtained by applying effects to estimated audio signals corresponding to audio objects comprised in said down-mix audio signals, said estimated audio signals being derived from the down-mix audio signals based on the parametric data, said modified down-mix audio signals based on a type of the applied effect being decoded by decoding means or rendered by rendering means or combined with the output of rendering means;

decoding the audio objects from the down-mix audio signals or the modified down-mix audio signals based on the parametric data, rendering means for generating at least one output audio signal from the decoded audio objects.

15. A method of transmitting and receiving audio signals, the method comprising:

at a transmitter performing the steps of:

receiving a plurality of audio objects, encoding the plurality of audio objects in at least one down-mix audio signal and parametric data, each down-mix audio signal comprising a down-mix of a plurality of audio objects, said parametric data comprising a plurality of object parameters for each of the plurality of audio objects, and transmitting down-mix audio signals and the parametric data to a receiver; and at the receiver performing the steps of:

receiving from the transmitter at least one down-mix audio signal and parametric data, each down-mix audio signal comprising a down-mix of a plurality of audio objects, said parametric data comprising a plurality of object parameters for each of the plurality of audio objects, generating modified down-mix audio signals; said modified down-mix audio signals obtained by applying effects to estimated audio signals corresponding to audio objects comprised in said down-mix audio signals, said estimated audio signals being derived from the down-mix audio signals based on the parametric data, said modified down-mix audio signals based on a type of the applied effect being decoded by decoding means or rendered by rendering means or combined with the output of rendering means;

decoding the audio objects from the down-mix audio signals or the modified down-mix audio signals based on the parametric data, generating at least one output audio signal from the decoded audio objects.

16. A computer program product, stored on a non-transitory recording medium, said computer program product providing instruction for a processor to execute the steps of:

receiving at least one down-mix audio signal and parametric data, each down-mix audio signal comprising a down-mix of plurality of audio objects, said parametric data comprising a plurality of object parameters for each of the plurality of audio objects;

generating modified down-mix audio signals; said modified down-mix audio signals obtained by applying effects to estimated audio signals corresponding to audio objects comprised in said down-mix audio signals, said estimated audio signals being derived from the down-mix audio signals based on the parametric data, said modified down-mix audio signals based on a type of the applied effect being decoded by decoding means or rendered by rendering means or combined with the output of rendering means;

decoding the audio objects from the down-mix audio signals or the modified down-mix audio signals based the parametric data;

generating at least one output audio signal from the decoded audio objects.

17. An audio playing device comprising an audio decoder said audio decoder comprising:

effect means for generating modified down-mix audio signals from received down-mix audio signals, said received down-mix audio signals comprising a down-mix of a plurality of audio objects, said modified down-mix audio signals obtained by applying effects to estimated audio signals corresponding to audio objects comprised in said received down-mix audio signals, said estimated audio signals being derived from the received down-mix audio signals based on received parametric data, said received parametric data comprising a plurality of object parameters for each of the plurality of audio objects, said modified down-mix audio signals based on a type of the applied effect being decoded by decoding means or rendered by rendering means or combined with the output of rendering means;

decoding means being arranged for decoding the audio objects from the down-mix audio signals or the modified down-mix audio signals based on the parametric data;

rendering means being arranged for generating at least one output audio signal from the decoded audio objects.

* * * * *